US006203414B1

(12) United States Patent
Numoto et al.

(10) Patent No.: US 6,203,414 B1
(45) Date of Patent: Mar. 20, 2001

(54) POLISHING APPARATUS

(75) Inventors: Minoru Numoto; Takao Inaba; Kenji Sakai; Hisashi Terashita; Manabu Satoh, all of Mitaka (JP)

(73) Assignee: Tokyo Seimitsu Co., Ltd., Tokyo (JP)

( * ) Notice: Subject to any disclaimer, the term of this patent is extended or adjusted under 35 U.S.C. 154(b) by 0 days.

(21) Appl. No.: 09/053,062

(22) Filed: Apr. 1, 1998

(30) Foreign Application Priority Data

Apr. 4, 1997 (JP) ..... 9-086814
May 28, 1997 (JP) ..... 9-138925

(51) Int. Cl.[7] ..... B24B 7/22
(52) U.S. Cl. ..... 451/288; 451/398
(58) Field of Search ..... 451/288, 287, 451/41, 398, 388

(56) References Cited

U.S. PATENT DOCUMENTS 5,584,746 * 12/1996 Tanaka et al. ..... 451/41
5,584,751 12/1996 Kobayashi et al. .

FOREIGN PATENT DOCUMENTS 0 362 811 4/1990 (EP) .
0 737 546 10/1996 (EP) .
56-89474 7/1981 (JP) .
1-88265 7/1989 (JP) .
404013567 * 1/1992 (JP) ..... 451/364
8-55826 2/1996 (JP) .
8-229808 9/1996 (JP) .
9-19863 1/1997 (JP) .
9-76152 3/1997 (JP) .
9-246218 9/1997 (JP) .

OTHER PUBLICATIONS

Patent Abstracts of Japan, vol. 014, No. 570 (M–1060), Dec. 18, 1990 & JP 02 243263 A (Hitachi Ltd), Sep. 27, 1990, *Abstract*.
Patent Abstracts of Japan, vol. 095, No. 008, Sep. 29, 1995 & JP 07 130689 A (Sony Corp), May 19, 1995, *Abstract*.
Patent Abstracts of Japan, vol. 012, No. 304 (E–646), Aug. 18, 1988 & JP 63 073625 A (Shin Etsu Handotai Co. Ltd), Apr. 4, 1988, *Abstract*.
"Pressurized Wafer Holder for Uniform Polishing", Research Disclosure, No. 322, Feb. 1, 1991, p. 95, XP000168310, *The Whole Document*.

* cited by examiner

*Primary Examiner*—Robert A. Rose
(74) *Attorney, Agent, or Firm*—Nixon Peabody LLP; David S. Safran

(57) ABSTRACT

The polishing apparatus comprises a turn table, which polishes a semiconductor wafer, and a holding and pressing part, which holds and presses the semiconductor wafer against a polishing surface of the turn table. The holding and pressing part transmits a force from an air bag to the semiconductor wafer via a pressurized fluid layer to thereby press the semiconductor wafer against the polishing surface via the pressurized fluid layer, so that the semiconductor wafer can be polished. Thereby, it is possible to uniformly polish the semiconductor wafer.

25 Claims, 9 Drawing Sheets

POLISHING APPARATUS

BACKGROUND OF THE INVENTION

1. Field of the Invention

The present invention relates generally to a polishing apparatus which polishes a wafer, and more particularly to a polishing apparatus which is able to uniformly polish a semiconductor wafer.

2. Description of Related Art

In a process of manufacturing semiconductor chips in which circuits are formed on a semiconductor material, the surface of a semiconductor wafer is polished by a polishing apparatus. The conventional polishing apparatus includes a polishing part and a holding and pressing part, which holds and presses the semiconductor wafer against a polishing surface of the polishing part. The polishing part is provided with a polishing pad, which has the polishing surface, and a turn table, on which the polishing pad is attached.

The wafer must be polished very accurately; however, even a very slight hollow or undulation on the polishing surface can cause the unevenness of the polishing.

Japanese Patent Provisional Publication No. 8-229808 discloses a polishing apparatus, in which the wafer is stuck to a carrier via a wafer adhesive sheet, and the carrier is pressed against a polishing pad via a diaphragm via pressurized fluid to polish the wafer. The polishing apparatus is provided with a tube between a head body and a retainer ring. The amount of air supplied to the tube is adjusted to control the force of the retainer ring which presses the polishing pad in order to prevent the polishing pad from being corrugated.

This polishing apparatus cannot deform the wafer in conformity with the hollows on the polishing surface because the wafer is stuck to the carrier via the wafer adhesive sheet. For this reason, the polishing pressure applied to the wafer cannot be uniform, and it is impossible to accurately polish the wafer.

In a conventional wafer polishing apparatus, a press ring is provided at a wafer holding head in such a manner as to enclose the edge of the wafer, and the press ring and the wafer are pressed against the rotating turn table so that the wafer can be polished. In another conventional wafer polishing apparatus, a retainer ring is provided at a carrier of the wafer holding head, and the retainer ring is in contact with the circumferential surface of the wafer so that the wafer can be polished with its position being regulated.

In these wafer polishing apparatuses, the rotational force of the turn table is transmitted to the carrier via the wafer, the retainer ring and the press ring. Thereby, the carrier tends to tilt unnecessarily due to the rotational force, and then, the polishing pressure cannot be uniform, and the wafer cannot be polished uniformly as a result. Pressing the carrier to such an extent as not to tilt the carrier can eliminate the above-mentioned disadvantage. In this case, however, the polishing pressure increases, and thus, the wafer cannot be polished accurately.

Japanese Patent Provisional Publication No. 1-188265 discloses a polishing apparatus, in which the air pressure is applied to a workpiece from behind to thereby polish the workpiece while keeping the workpiece and a workpiece holder in non-contact state. The pressure for machining the workpiece is set by controlling the flow of the air supplied to the back of the workpiece by means of a flow control valve.

In this polishing apparatus, only the air layer cannot absorb the tilt of the rotary head, and the pressing force cannot be maintained constant. Thus, it is impossible to accurately polish the wafer.

Japanese Patent Provisional Publication No. 8-55826 discloses a polishing apparatus, in which a liquid such as pure water is supplied into a space between a holding head and the reverse surface of a substrate to form a fluid film between them. The holding head holds the substrate with a surface tension of the fluid film to polish the substrate which is pressed against a turn table.

This polishing apparatus uses the liquid, and thus, the density or component of slurry changes to deteriorate the flatness of the wafer and the polishing rate. If the amount of the liquid supplied is decreased or adjusted to eliminate the above-mentioned disadvantage, the liquid cannot flow uniformly on the reverse surface of the wafer. Thus, it is impossible to accurately polish the wafer.

SUMMARY OF THE INVENTION

The present invention has been developed in view of the above-described circumstances, and has as its object the provision of a polishing apparatus which is able to uniformly and accurately polish a wafer.

To achieve the above-mentioned object, a polishing apparatus of the present invention, which holds a wafer with a holding head and presses the wafer against a rotating turn table to thereby polish a face of the wafer, is characterized in that the holding head comprises: a head body which is rotatably arranged such that the head body faces the turn table; a carrier which floats on the head body in such a manner as to move vertically; an air jetting member which is provided at the bottom of the carrier and jets air to the other face of the wafer to thereby form a pressurized fluid layer between the carrier and the wafer; and a pressing means which presses the carrier toward the turn table to thereby press the wafer against the turn table via the pressurized fluid layer.

According to the present invention, the carrier is floating on the head body in a manner to move vertically, and the wafer is pressed via the pressurized fluid layer. For this reason, the frictional force and the rotational force of the turn table is not transmitted to the carrier while the wafer is being polished, and thus, the balance of the pressing force can be kept. If the polishing surface is corrugated, the position of the carrier or wafer can follow the shape of the polishing surface. Moreover, the wafer is uniformly pressed by the pressurized fluid layer whether the wafer is deformed or not, and thereby, the wafer is pressed against the polishing surface along the undulations and hollows on the polishing surface of the polishing part. Thus, it is possible to polish the wafer uniformly and accurately.

According to the present invention, the pressing means presses the carrier via pressurized fluid.

According to the present invention, liquid or air is used as the fluid.

According to the present invention, a piezo-electric device is used as the pressing means, and a voltage is applied to the piezo-electric device so that the piezo-electric device can expand. The piezo-electric device presses the carrier as a result. According to the present invention, the pressing force is determined by controlling the voltage. A magnetostriction device may be used instead of the piezo-electric device.

According to the present invention, a spring member is used as the pressing means. The pressing force can be determined by the force of the spring member.

According to the present invention, a porous member is used as the air jetting member.

According to the present invention, a member provided with air jetting holes is used as the air jetting member.

According to the present invention, the carrier which is provided with air jetting holes is used as the air jetting member.

If the wafer is pressed against the polishing surface under uniform pressure, a deformation stress, which is generated on the polishing surface when the edge of the wafer bites into the polishing surface, is added to the edge part of the wafer. For this reason, the edge part is polished by a larger amount than the other parts.

According to the present invention, the air jetting member comprises the first and second air jetting members. The pressure which is applied to the edge part of the wafer by the air jetted from the second air jetting member is set lower than the pressure applied to the central part of the wafer by the air jetted from the first air jetting member. The edge part of the wafer is pressed under the pressure which is lower by the deformation stress that is generated when the edge of the wafer bites into the polishing surface than the pressure applied to the central part of the wafer, so that the polishing pressure can be uniform on the whole surface of the wafer. Thus, it is possible to uniformly polish the wafer.

According to the present invention, porous members are used as the first and second air jetting members.

According to the present invention, members provided with air jetting holes are used as the first and second air jetting members.

To achieve the above-mentioned object, a polishing apparatus of the present invention, which holds a wafer with a holding head and presses the wafer against a rotating turn table to thereby polish a face of the wafer, is characterized in that the holding head comprises: a head body which is rotatably arranged such that the head body faces the turn table; a carrier which floats on the head body in such a manner as to move vertically; an air jetting member which is provided at the bottom of the carrier and jets air to the other face of the wafer to thereby form a pressurized fluid layer between the carrier and the wafer; and a first pressing means which presses the carrier toward the turn table to thereby press the wafer against the turn table via the pressurized fluid layer; a press ring which is supported by the head body in such a manner as to move vertically and which is concentrically arranged outside the carrier, the press ring enclosing the wafer during polishing; and a second pressing means which presses the press ring against the turn table.

According to the present invention, since the carrier supports the wafer via the pressurized fluid layer, the frictional force applied to the wafer is not transmitted to the carrier while the wafer is being polished. Moreover, the carrier and the press ring are supported via the pressurized fluid, and the wafer is pressed against the polishing surface via the pressurized fluid layer. Then, if the polishing surface of the turn table is corrugated, the position of the carrier follows to the shape of the polishing surface. Thus, even if the polishing surface is corrugated, the whole surface of the wafer is pressed against the polishing surface under uniform pressure, so that the wafer can uniformly be polished.

According to the present invention, the retainer ring is provided at the inner surface of the press ring. Thus, it is possible to prevent the wafer from jumping during polishing, and the polishing force, which acts on the retainer ring, is not transmitted to the carrier.

According to the present invention, at least a part of the retainer ring which meets the wafer is made of resin so as to prevent the wafer from chipping.

According to the present invention, a means which presses the carrier via pressurized fluid is used as the first and second pressing means.

According to the present invention, liquid or the air is used as the fluid.

According to the present invention, a piezo-electric device is used as at least one of the first and second pressing means, and a voltage is applied to the piezo-electric device so that the piezo-electric device can expand. The piezo-electric device presses the carrier or the press ring as a result. According to the present invention, the pressing force is determined by controlling the voltage. A magnetostriction device may be used instead of the piezo-electric device.

According to the present invention, a spring member is used as at least one of the first and second pressing means, and the pressing force can be determined by the force of the spring member.

According to the present invention, a porous member is used as the air jetting member.

According to the present invention, a member provided with air jetting holes is used as the air jetting member.

According to the present invention, the carrier which is provided with air jetting holes is used as the air jetting member.

According to the present invention, the air jetting member comprises the first and second air jetting members. The pressure which is applied to the edge part of the wafer by the air jetted from the second air jetting member is set lower than the pressure applied to the central part of the wafer by the air jetted from the first air jetting member. The edge part of the wafer is pressed under the pressure which is lower by the deformation stress that is generated when the edge of the wafer bites into the polishing surface than the pressure applied to the central part of the wafer, so that the polishing pressure can be uniform on the whole surface of the wafer. Thus, it is possible to uniformly polish the wafer.

According to the present invention, porous members are used as the first and second air jetting members.

According to the present invention, members provided with air jetting holes are used as the first and second air jetting members.

According to the present invention, a projection is formed on the bottom of the head body, and the projection is in contact with the circumferential surface of the bottom of the press ring to regulate the inclination of the press ring.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be described in further detail by way of example with reference to the accompanying drawings.

Figure 1:
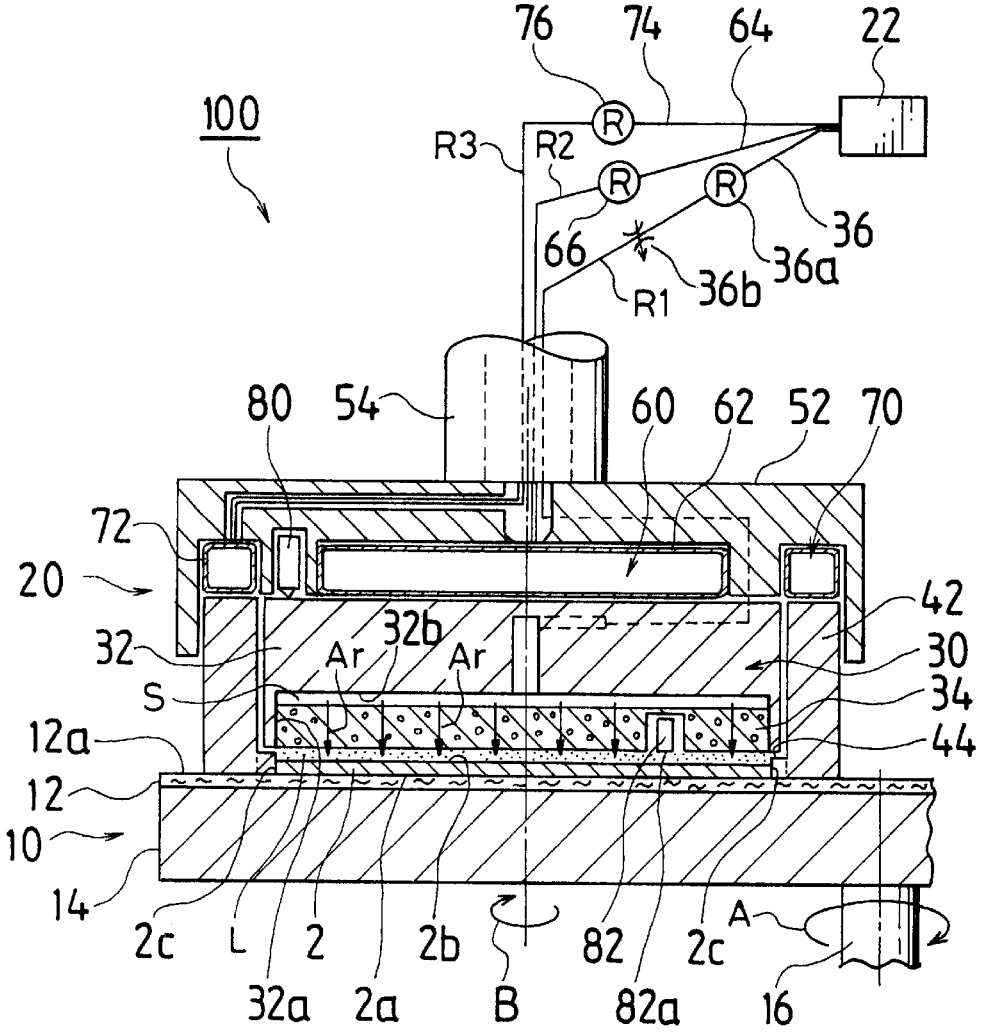
FIG. 1 is a sectional view illustrating the first embodiment of the polishing apparatus of the present invention.

As shown in FIG. 1, a polishing apparatus 100 in the first embodiment of the present invention comprises: a turn table 10, which polishes a semiconductor wafer 2; and a holding head 20, which holds and rotates the semiconductor wafer 2 while pressing it against the turn table 10 with a desired polishing pressure.

The turn table 10 comprises: an polishing pad 12, which has a circular polishing surface 12*a* which polishes a polished surface 2*a* of the semiconductor wafer 2; a rotary plate 14, on which the polishing pad 12 is attached; and a rotation driving part 16, which rotates the rotary plate 14 in a horizontal polishing direction (in the direction of an arrow A in FIG. 1) relatively to the holding head 20.

The holding head 20 comprises: a fluid pressing part 30, which forms a pressurized fluid layer L, which is in contact with a reverse surface 2*b* of the semiconductor wafer 2 and presses the semiconductor wafer 2; a cylindrical retainer ring 42, which encloses the fluid pressing part 30 and presses the polishing surface 12*a* of the polishing pad 12 around the semiconductor wafer 2; a holding part 44, which is integrated with the inner surface at the bottom of the retainer ring 42 and holds a circumferential surface 2*c* of the semiconductor wafer 2; a head body 52, which is disposed above the fluid pressing part 30 and the retainer ring 42; a rotation driving part 54, which rotates the head body 52; a first adjusting part 60, which is arranged between the head body 52 and the fluid pressing part 30 and adjusts the polishing pressure applied to the fluid pressing part 30; and a second adjusting part 70, which is arranged between the head body 52 and the retainer ring 42 and applies and adjusts pressure to the retainer ring 42 to press the polishing pad 12.

The retainer ring 42 is coupled onto the head body 52 via a stopper member (not shown), which prevents the retainer ring 42 from falling out of the head body 52.

The fluid pressing part 30 comprises: a carrier 32, which has a concave 32*a* opened toward substantially the whole area of the reverse surface 2*b* of the semiconductor wafer 2; an air-permeable porous board (an air jetting member) 34, which is fitted in the bottom end of the concave 32*a* and is disposed away from the reverse surface 2*b* of the semiconductor wafer 2; and an air supply mechanism 36, which supplies the air Ar into a space S between a ceiling 32*b* of the concave 32*a* and the porous board 34.

The carrier 32 is in contact with the holding part 44 of the retainer ring 42 so that the carrier 32 can be prevented from falling out of the retainer ring 42. The carrier 32 and the retainer ring 42 are floating in such a manner as not to interfere with one another.

The porous board 34 has a number of air passages therein, and it is composed of sintered ceramics for example.

The air supply mechanism 36 comprises: a pump 22; and a regulator 36*a* adjusting the pressure of the supplied air Ar and a valve 36*b* adjusting the flow of the air Ar, which are provided on an air supply passage R1 between the pump 22 and the concave 32*a*.

The first adjusting part 60 comprises: an air bag (pressing means) 62, which is arranged between the head body 52 and the fluid pressing part 30 and expands and contracts with inflow and outflow of the air to adjust the polishing pressure; and an air supply mechanism 64, which supplies the air to the air bag 62. The air supply mechanism 64 comprises: the pump 22 (another pump may be provided instead of the pump 22); and a regulator 66, which is provided on an air supply passage R2 between the pump 22 and the air bag 62 and adjusts the pressure of the supplied air.

The second adjusting part 70 comprises: an air bag 72, which is arranged between the head body 52 and the retainer ring 42 and expands and contracts with inflow and outflow of the air to regulate the polishing surface; and an air supply mechanism 74, which supplies the air to the air bag 72. The air supply mechanism 74 comprises: the pump 22 (another pump may be provided instead of the pump 22); and a regulator 76, which is provided on an air supply passage R3 between the pump 22 and the air bag 72 and adjusts the pressure of the supplied air.

A description will be given of a method of polishing the semiconductor wafer 2 by the polishing apparatus 100.

First, the air supply mechanism 64 of the first adjusting part 60 adjusts the air pressure in the air bag 62, thereby adjusting the polishing pressure which is applied to the fluid pressing part 30.

The air supply mechanism 36 supplies the air Ar, of which pressure and flow have already been adjusted, to the space S between the ceiling 32*b* of the concave 32*a* and the porous board 34. Then, the air Ar collects in the space S to equalize the pressure thereof, and the air Ar gently flows through the porous board 34 at a constant rate into a space between the porous board 34 and the reverse surface 2*b* of the semiconductor wafer 2. Thereby, the air Ar forms the pressurized fluid layer L, which transmits the polishing pressure uniformly over the whole area of the reverse surface 2*b*. The air Ar forming the pressurized fluid layer L flows out by the same amount as a inflow of the air Ar.

Figure 2:
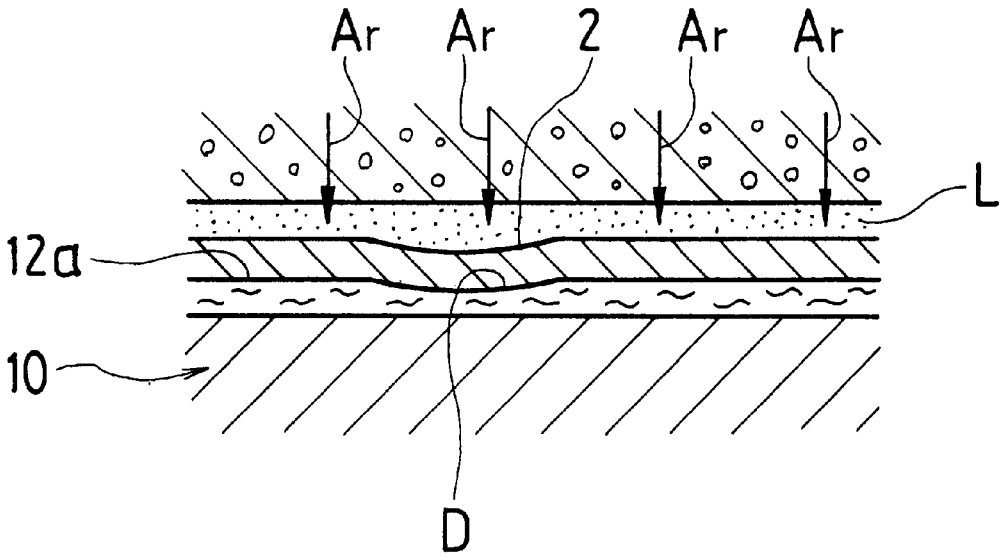
FIG. 2 is a view describing the deformation of the semiconductor wafer, which results from the undulations on the polishing pad of the polishing apparatus in FIG. 1.

Thus, the pressurized fluid layer L presses the whole area of the reverse surface 2*b* of the semiconductor wafer 2 whether the semiconductor wafer 2 is deformed or not. Even if there is an undulation or concave D on the polishing surface 12*a* of the turn table 10 as shown in FIG. 2, the semiconductor wafer 2 is pressed against the polishing surface 12*a* along the undulation or concave D. The semiconductor wafer 2 is pressed against the polishing surface 12*a* uniformly over the whole area of the polished surface 2*a*.

The second adjusting part 70 in FIG. 1 adjusts the force of the retainer ring 42 to press the polishing pad 12. Thereby it is possible to prevent the polishing surface 12*a* from rising around the semiconductor wafer 2.

Then, the rotation driving part 16 of the turn table 10 is activated to rotate the polishing pad 12 with the rotary plate 14 in the horizontal polishing direction (the direction of the arrow A in FIG. 1), and the rotation driving part 54 of the holding head 20 is activated to rotate the head body 52 in the direction of an arrow B in FIG. 1. Thus, the semiconductor wafer 2 is polished.

The semiconductor wafer 2 is uniformly polished since the semiconductor wafer 2 is pressed against the polishing surface 12*a* along the undulation or concave D thereon as shown in FIG. 2, and the polishing surface 12*a* is prevented from rising around the semiconductor wafer 2 as shown in FIG. 1.

In this embodiment, the polishing apparatus 100 is provided with an instrument for measuring the thickness of the semiconductor wafer 2. The measuring instrument comprises a contact sensor 80, a non-contact sensor 82, and a CPU (not shown), which calculates the thickness of the semiconductor wafer 2 according to data obtained with the sensors 80, 82.

The sensor 80 is in contact with the top of the carrier 32, and it measures a change in the movement of the carrier 32 with respect to the polishing surface 12*a*. The sensor 80 can measure the approximate thickness of the semiconductor wafer 2. In this embodiment, moreover, the measured value of the sensor 80 is corrected by a measured value of the sensor 82, so that the accurate thickness of the semiconductor wafer 2 can be found.

The sensor 82 is the non-contact sensor such as an eddy current sensor, and a sensing surface 82*a* of the sensor 82 is flush with the bottom of the fluid pressing part 30. The sensor 82 measures a change in the thickness of the pressurized fluid layer L by measuring the distance between the sensor 82 and the reverse surface 2*b* of the semiconductor wafer 2.

The CPU adds the change in the thickness of the pressurized fluid layer L, which is measured with the sensor 82, to the movement amount of the holding head 20, which is measured with the sensor 80. In other words, the CPU calculates the thickness of the semiconductor wafer 2 according to the change amounts with respect to previously-stored reference values. For instance, if the change amount measured with the sensor 80 is T1, and the change amount measured with the sensor 82 is T2, the thickness of the semiconductor wafer 2 is T1+T2. If the change amount measured with the sensor 80 is T1, and the change amount measured with the sensor 82 is 0, the thickness of the semiconductor wafer 2 is T1. If the change amount measured with the sensor 80 is T1, and the change amount measured with the sensor 82 is −T2, the thickness of the semiconductor wafer 2 is T1−T2.

As stated above, there are provided two sensors 80, 82 to calculate the thickness of the semiconductor wafer 2 from two change amounts in this embodiment, and thus, it is possible to correctly measure the thickness of the semiconductor wafer 2.

Figure 3:
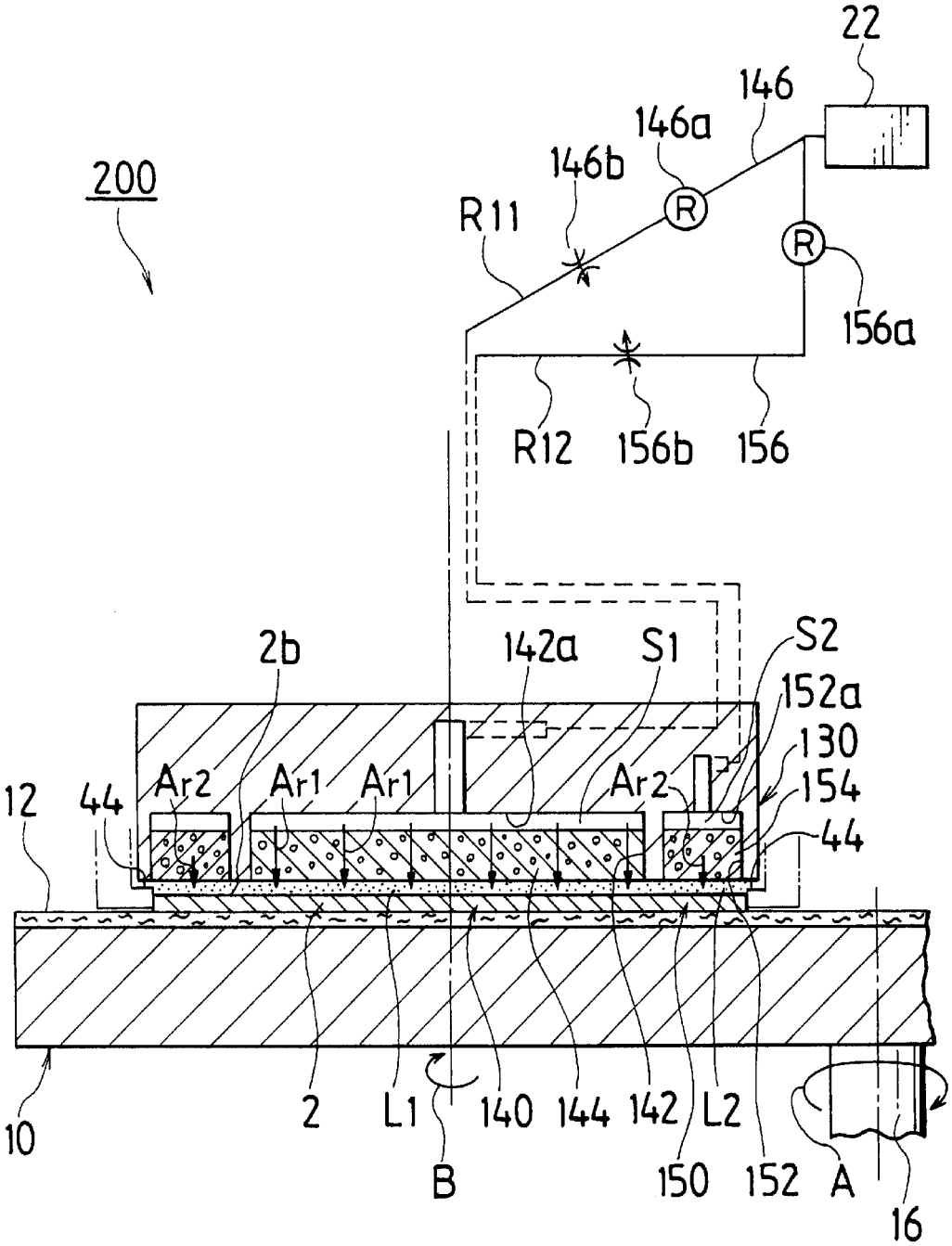
FIG. 3 is a sectional view illustrating the essential parts of the second embodiment of the polishing apparatus of the present invention.

FIG. 3 shows the essential parts of a polishing apparatus 200 of the second embodiment of the present invention. The polishing apparatus 200 is different from the polishing apparatus 100 in FIG. 1 in that the retainer ring 42 and the second adjusting part 70 are not provided, and that a fluid pressing part 130 as shown in FIG. 3 is provided instead of the fluid pressing part 30.

The fluid pressing part 130 comprises: a central pressing part 140, which forms a pressurized fluid layer central part L1 pressing the central part of the reverse surface 2*b* of the semiconductor wafer 2; and an edge pressing part 150, which forms a pressurized fluid layer edge part L2 pressing the edge part of the reverse surface 2*b* of the semiconductor wafer 2 with lower pressure than the pressurized fluid layer central part L1.

The central pressing part 140 comprises: a concave 142, which is opened toward the central part of the reverse surface 2*b* of the semiconductor wafer 2; an air-permeable porous board 144, which is fitted in the bottom end of the concave 142 and is disposed away from the reverse surface 2*b* of the semiconductor wafer 2; and an air supply mechanism 146, which supplies the air Ar1 into a space S1 between a ceiling 142*a* of the concave 142 and the porous board 144.

The air supply mechanism 146 comprises: a pump 22; a regulator 146*a* adjusting the pressure of the supplied air Ar1 and a valve 146*b* adjusting the flow of the air Ar1, which are provided on an air supply passage R11 between the pump 22 and the concave 142.

The edge pressing part 150 comprises: a concave 152, which is annularly opened toward the edge part of the reverse surface 2*b* of the semiconductor wafer 2; an air-permeable porous board 154, which is fitted in the bottom end of the concave 152 and is disposed away from the reverse surface 2*b* of the semiconductor wafer 2; and an air supply mechanism 156, which supplies the air Ar2 into a space S2 between a ceiling 152*a* of the concave 152 and the porous board 154.

The air supply mechanism 156 comprises: the pump 22 (another pump may be provided instead of the pump 22); a regulator 156*a* adjusting the pressure of the supplied air Ar2 and a valve 156*b* adjusting the flow of the air Ar2, which are provided on an air supply passage R12 between the pump 22 and the concave 152.

The porous boards 144, 154 have a number of air passages therein, and they are composed of sintered ceramics for example.

Figure 4:
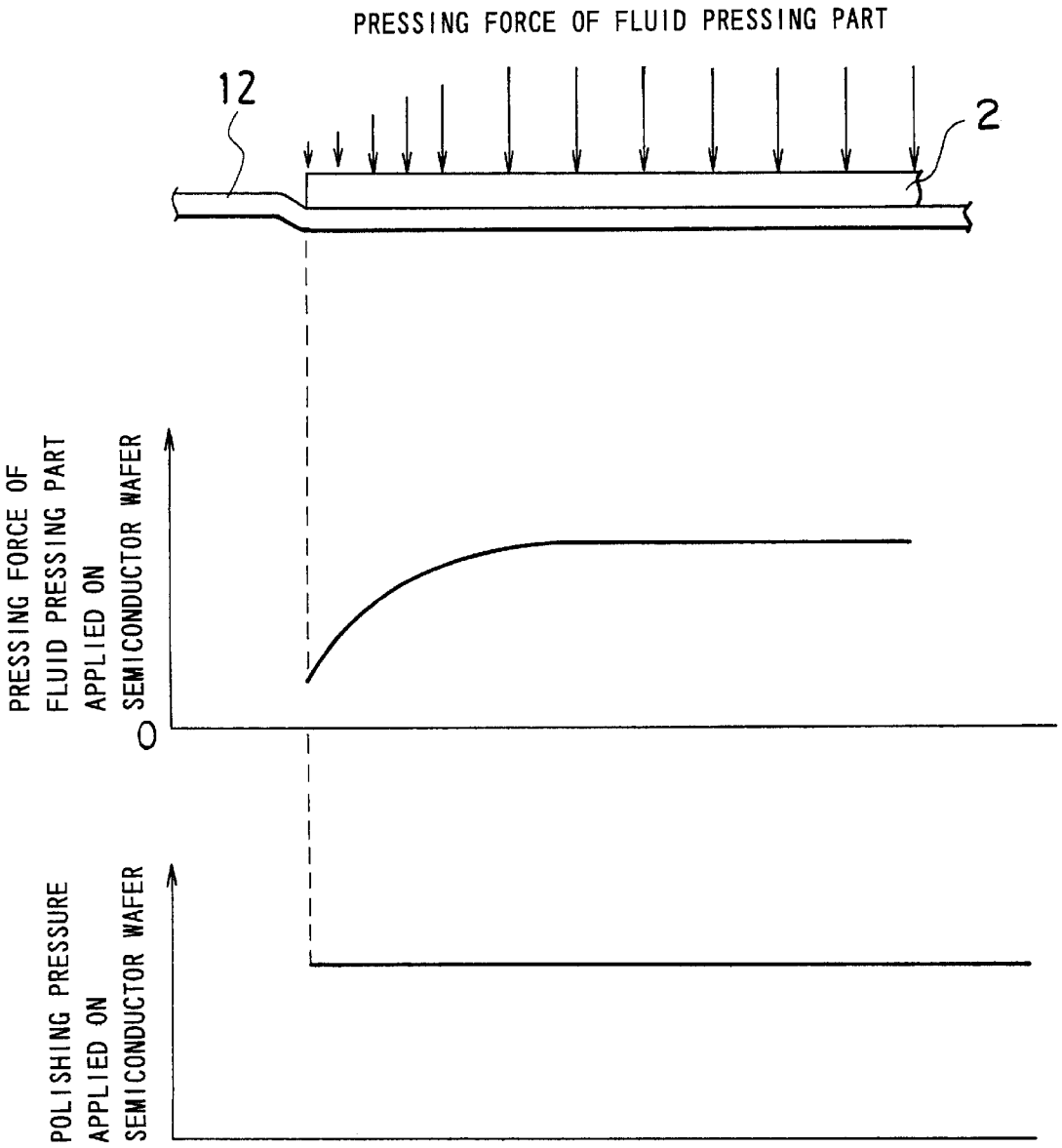
FIG. 4 is a view describing the pressing force of a fluid pressing part and the polishing pressure applied on a semiconductor wafer in the polishing apparatus in FIG. 3.

According to the polishing apparatus 200, the pressing force against the semiconductor wafer 2 gradually decreases from the central part to the edge part thereof, and then, the polishing pad 12 can uniformly apply the polishing pressure to the semiconductor wafer 2. Further in detail, if the semiconductor wafer is pressed against the polishing surface with uniform pressure, the edge part of the semiconductor wafer is applied higher polishing pressure from the polishing surface than the other parts of the semiconductor wafer by pressure generated through a deformation stress of the polishing surface, which is caused by biting of the edge of the semiconductor wafer into the polishing surface, and then, the edge part is polished more than the other parts. To solve this problem, in this embodiment, the fluid pressing part 130 presses the edge part of the reverse surface 2*b* of the semiconductor wafer 2 with lower pressure than the central part of the reverse surface 2*b* of the semiconductor wafer 2 by the pressure generated through the deformation stress of the polishing pad 12 as shown in FIG. 4. Thereby, the polishing pad 12 can apply the uniform polishing pressure to the polished surface 2*a* of the semiconductor wafer 2. Thus, it is possible to uniformly polish the semiconductor wafer 2 in this embodiment.

Accordingly, the retainer ring 42 and the second adjusting part 70 in FIG. 1 do not have to be provided, and thus, it is possible to reduce drive energy and eliminate the necessity to replace the abraded retainer ring 42.

The polishing apparatuses 100, 200 may be applied not only to the semiconductor wafer 2 but also to any type of wafers.

In these embodiments, the air is supplied to the air bag 62 to press the carrier 32, but the present invention is not restricted to this. The water may be supplied to the air bag 62 to press the carrier 32. In other words, any type of fluid may be supplied to the air bag 62. This applies to the air bag 72, too.

Figure 5:
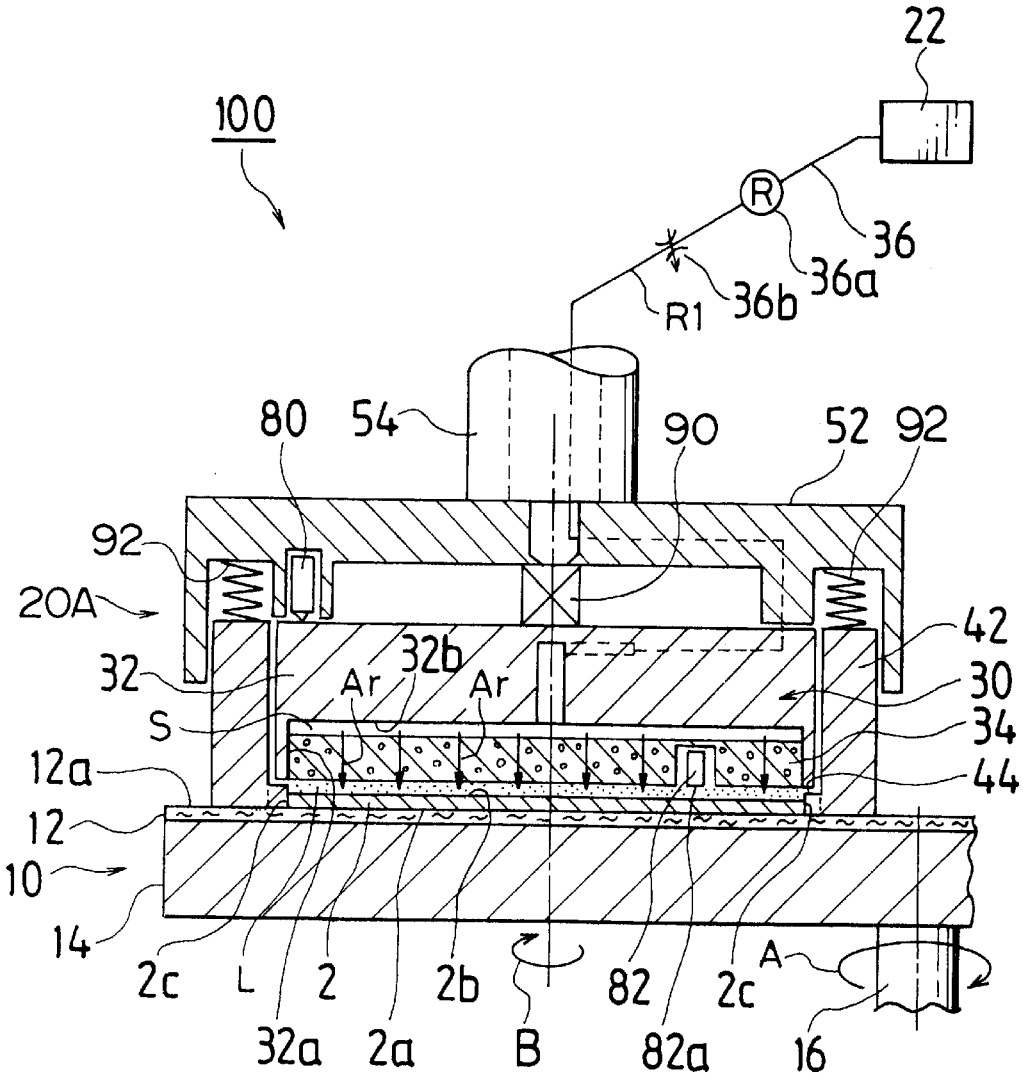
FIG. 5 is a sectional view of a wafer holding head in a polishing apparatus of the third embodiment of the present invention wherein a piezo-electric device and a coil spring are employed as pressing means.

FIG. 5 is a sectional view illustrating a holding head 20A in a polishing apparatus of the third embodiment of the present invention, in which a piezo-electric device 90 is employed as a means which presses the carrier 32. Parts similar to those described with reference to FIG. 1 are denoted by the same reference numerals, and a description of them will be omitted.

When a voltage is applied to the piezo-electric device 90 from a power supply (not shown), the piezo-electric device expands vertically in FIG. 5, and the piezo-electric device 90 presses the carrier 32 downward. Thereby, the piezo-electric device 90 applies force to the carrier 32, and the force is transmitted to the wafer 2 via the pressurized fluid layer L. Thus, the wafer 2 is pressed against the polishing pad 12 so that the wafer 2 can be polished. A voltage control unit (not shown) controls the voltage applied to the piezo-electric device 90 to control the expansion of the piezo-electric device 90 so that the force can be controlled. In FIG. 5, coil springs 92 are employed as the pressing means of the retainer ring 42. A magnetostriction device may be employed instead of the piezo-electric device 90.

Figure 6:
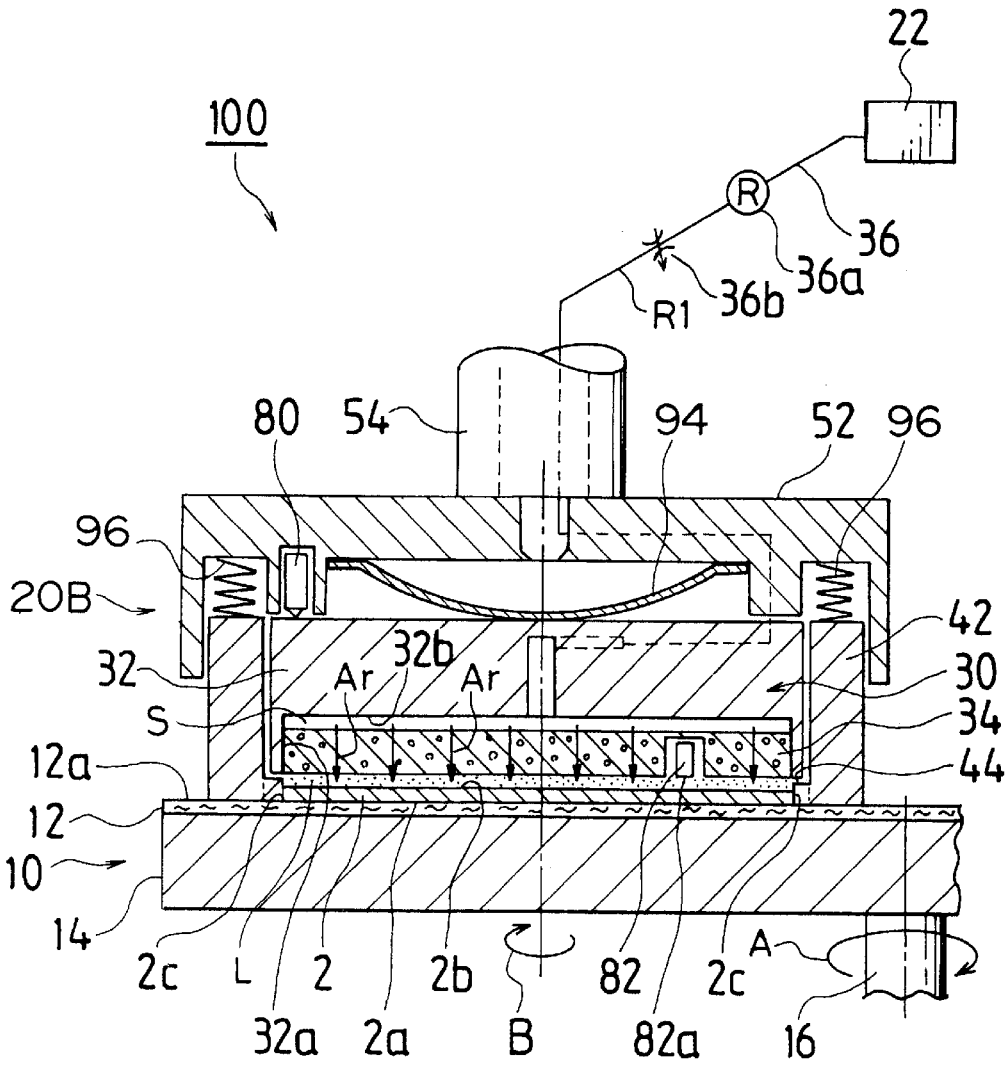
FIG. 6 is a sectional view of a wafer holding head in a polishing apparatus of the fourth embodiment of the present invention wherein a leaf spring and a coil spring are employed as pressing means.

FIG. 6 is a sectional view illustrating a holding head 20B in a polishing apparatus of the fourth embodiment of the present invention, in which a leaf spring 94 is employed as a means which presses the carrier 32. Parts similar to those described with reference to FIG. 1 are denoted by the same reference numerals, and a description of them will be omitted.

The leaf spring 94 is arranged in a gap between the head body 52 and the carrier 32, and the leaf spring 94 presses the carrier 32 downward, and the force of the leaf spring 94 is transmitted to the wafer 2 via the pressurized fluid layer L. Thus, the wafer 2 is pressed against the polishing pad 12 so that the wafer 2 can be polished. The leaf spring 94 has an optimum spring constant for polishing the wafer 2. In FIG. 6, coil springs 86 are employed as the pressing means of the retainer ring 42.

Two piezo-electric devices, the piezo-electric device and the air bag, or the spring and the air bag may be employed as the pressing means of the carrier 32 and the retainer ring 42.

Figure 7:
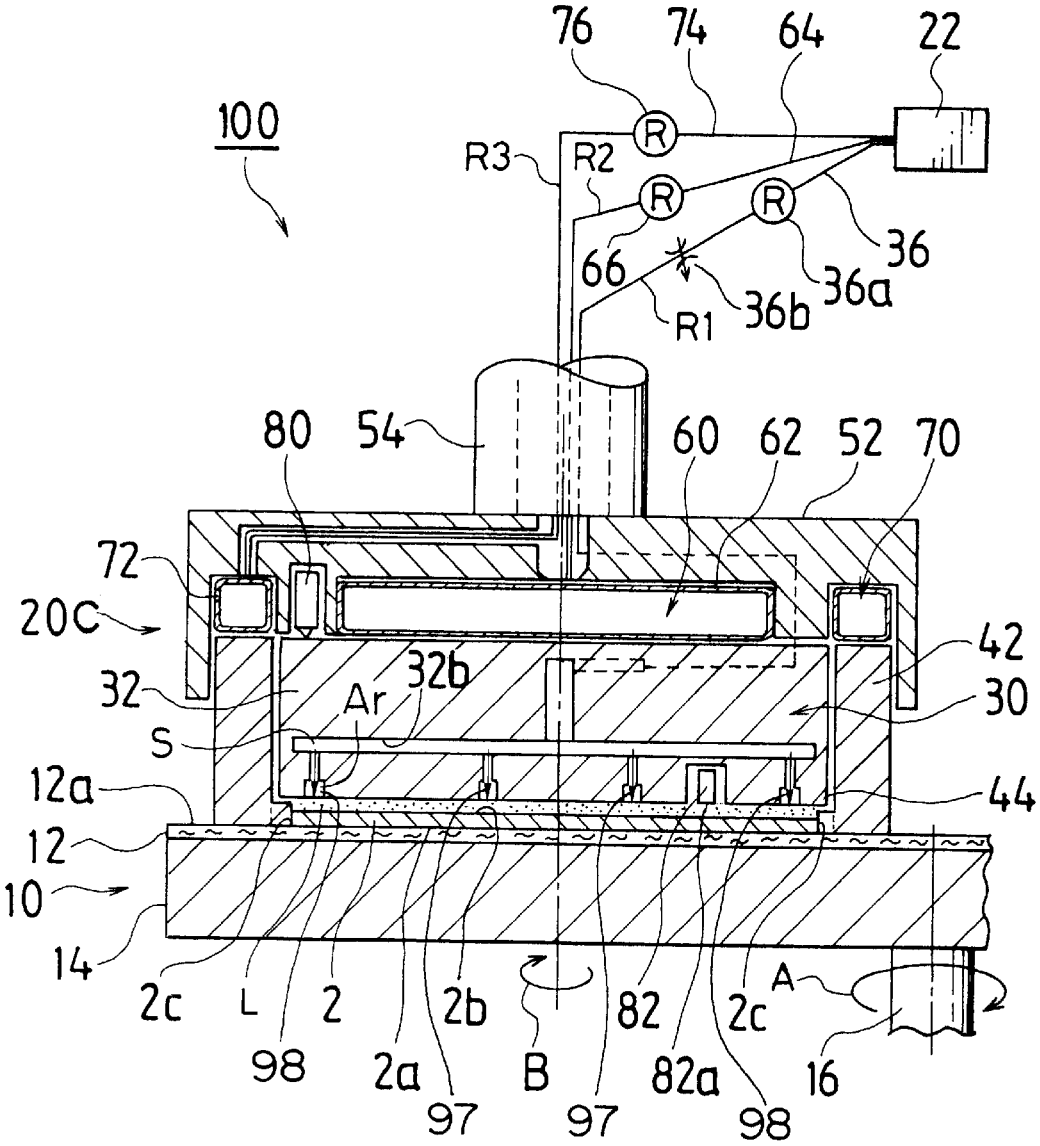
FIG. 7 is a sectional view of a wafer holding head in a polishing apparatus of the fifth embodiment of the present invention wherein air jetting holes are formed on a carrier.

FIG. 7 is a sectional view illustrating a holding head 20C in a polishing apparatus of the fifth embodiment of the present invention, in which air jetting holes 97, 98 are formed on the carrier 32 without using the porous board 34 as the air jetting member. A number of air jetting holes 97 are formed in a circle with center on the rotational axis of the carrier 32, and they are arranged to face the central part of the wafer 2. A number of air jetting holes 98 are formed in a circle outside the air jetting holes 97 with center on the rotational axis of the carrier 32, and they are arranged to face the edge part of the wafer 2. The carrier 32 on which the air jetting holes 97, 98 are formed can achieve the same effects as the porous board 34.

If the pressure of the air jetted from the air jetting holes 97 and the pressure of the air jetted from the air jetting holes 98 are separately controlled, and the pressure applied to the edge part of the wafer 2 by the air from the air jetting holes 98 is set lower than the pressure applied to the central part of the wafer 2 by the air from the air jetting holes 97, the polishing apparatus of this embodiment can achieve the same effects as the polishing apparatus 200 in FIG. 3. In FIG. 7, the air jetting holes 97, 98 are formed on the carrier 32, but the present invention is not restricted to this. A member which is provided with the air jetting holes 97, 98 may be attached to the carrier 32.

Figure 8:
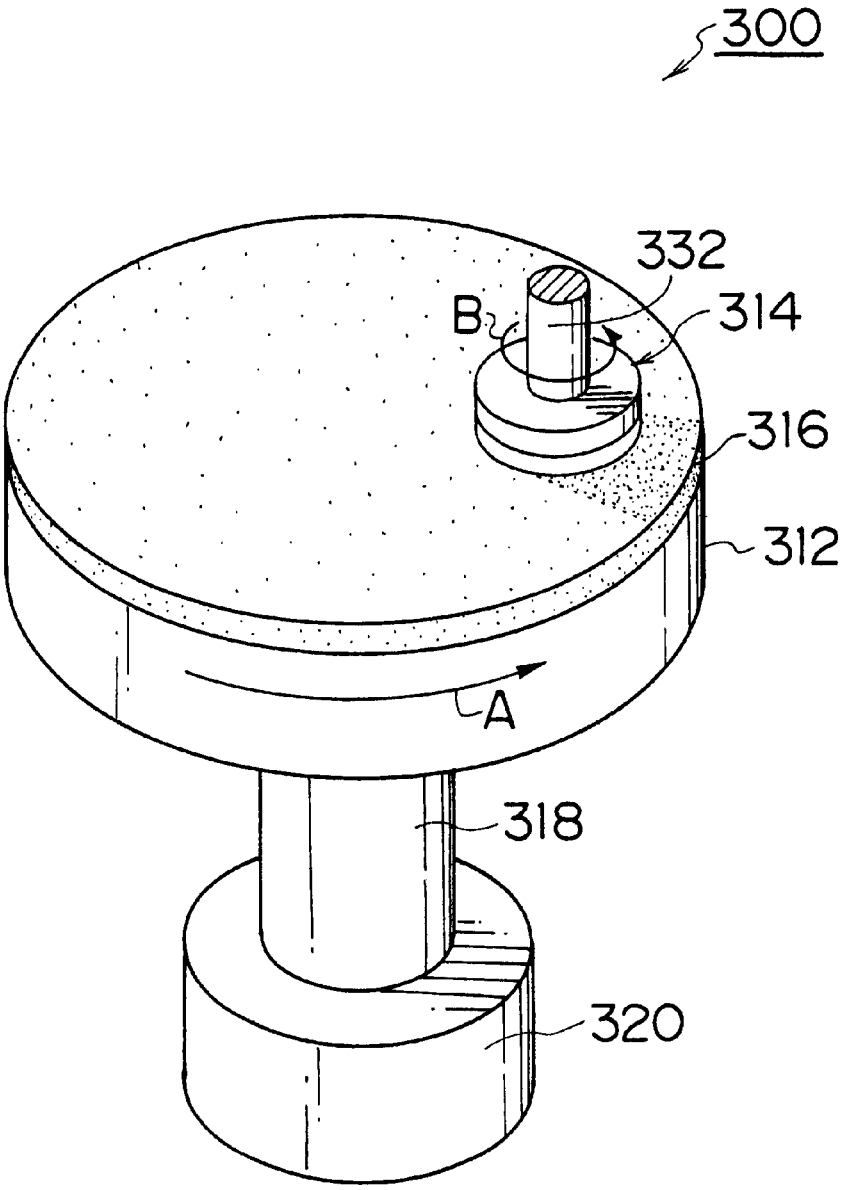
FIG. 8 is a view illustrating the entire structure of a polishing apparatus of the sixth embodiment of the present invention.

FIG. 8 is a view illustrating the entire structure of a wafer polishing apparatus of the sixth embodiment of the present invention.

As shown in FIG. 8, a wafer polishing apparatus 300 comprises a turn table 312 and a wafer holding head 314. The turn table 312 is shaped like a disc, and a polishing pad 316 is attached at the top thereof. A spindle 318 connects to the bottom of the turn table 312, and the spindle 318 connects to an output shaft (not shown) of a motor 320. When the motor 320 is driven, the turn table 312 rotates in the direction of an arrow A, and a slurry is supplied from a nozzle (not shown) onto the polishing pad 316 of the rotating turn table 312.

Figure 9:
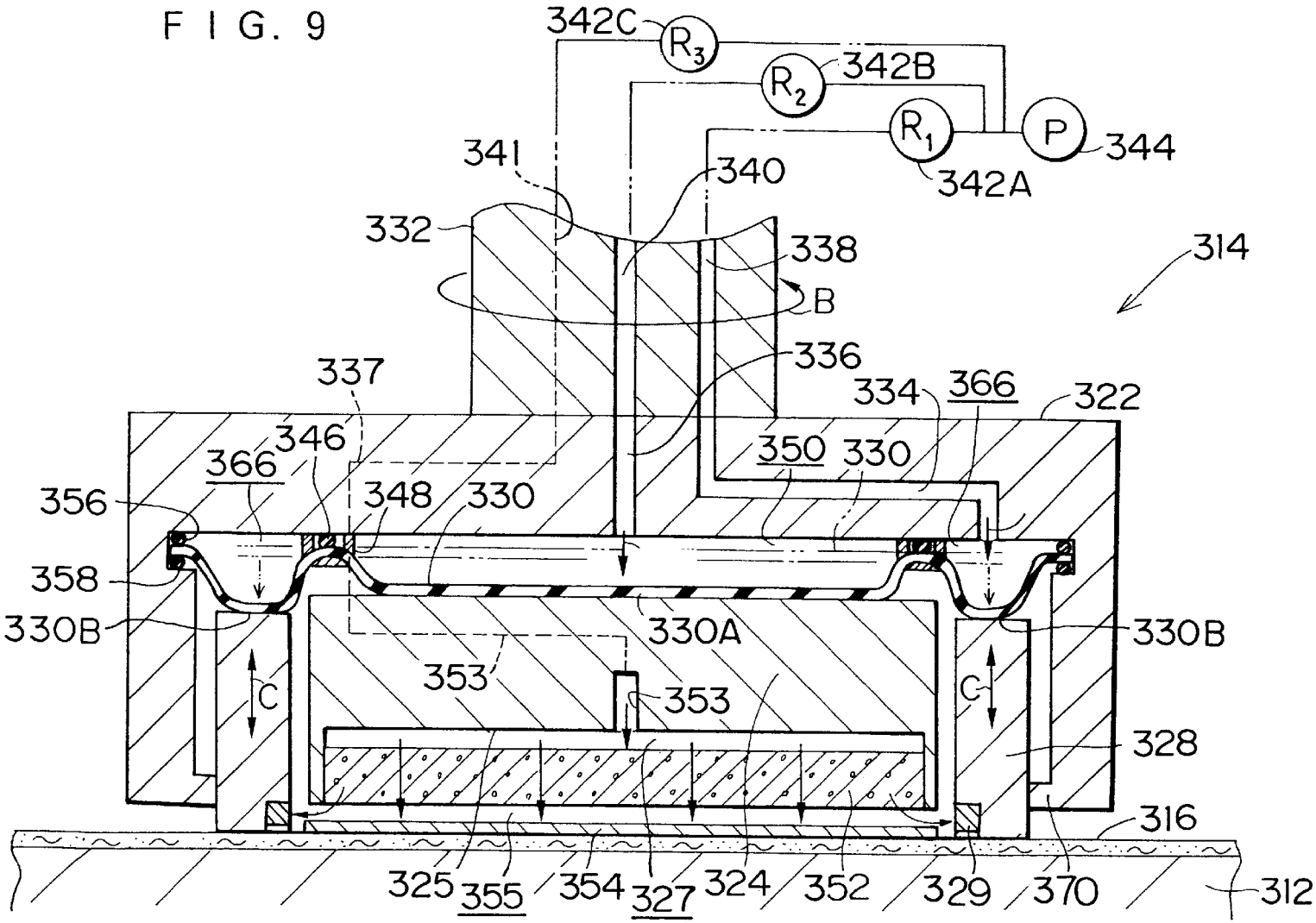
FIG. 9 is a sectional view of a wafer holding head in the polishing apparatus in FIG. 8.

FIG. 9 is a longitudinal sectional view of the wafer holding head 314. The wafer holding head 314 comprises a head body 322, a carrier 324, a press ring 328, and a rubber sheet 330. The head body 322 is shaped like a cup opened downward, and it is rotated in the direction of an arrow B by a motor (not shown) which connects to a rotary shaft 332. Air supply passages 334, 336, 337 are formed in the head body 322, and they respectively communicate with air supply passages 338, 340, 341 which are formed in the rotary shaft 332. The air supply passage 338 is connected to a pump 344 via a regulator 342A, the air supply passage 340 is connected to the pump 344 via a regulator 342B, and the air supply passage 341 is connected to the pump 344 via a regulator 342C.

The carrier 324 is shaped like a disc, and it is received in the head body, 322 coaxially therewith. A concave 325 is formed at the bottom of the carrier 324, and an air-permeable porous board 352 is fitted in the concave 325. An air chamber 327 is formed over the porous board 352, and an air supply passage 353 communicates with the air chamber 327. The air supply passage 353 communicates with the above-mentioned air supply passage 337. Thus, the compressed air is supplied from the pump 344 to the air chamber 327 through the air supply passages 341, 337, 353. Then, the air passes through the porous board 352 and is jetted downward from the bottom thereof. Thereby, the pressure of the carrier 324 is transmitted to the wafer 354 through a pressurized air layer 355, and the wafer 354 is uniformly pressed against the polishing pad 316. The regulator 342C adjusts the air pressure to control the force which presses the wafer 354 against the polishing pad 316. If the carrier 324 directly presses the wafer 354 against the polishing pad 316, the force of the carrier 324 cannot uniformly be transmitted to the whole surface of the wafer 354 when there is some dust between the carrier 324 and the wafer 354. If the wafer 354 is pressed against the polishing pad 316 via the pressurized air layer 355, the force of the carrier 324 can uniformly be transmitted to the whole surface of the wafer 354 when there is some dust between the carrier 324 and the wafer 354. The air is jetted from the porous board 352 and is discharged to the outside through an air exit (not shown) formed in the press ring 328.

The porous board 352 has a number of air passages therein, and it is composed of sintered ceramics for example.

The rubber sheet 330 has the uniform thickness and it is shaped like a disc. The rubber sheet 330 is fixed to the head body 322 by a fastening 348 via an O-ring 346, and the rubber sheet 330 is divided into a central part 330A and an outer part 330B at the fastening 348. The central part 330A of the rubber sheet 330 presses the carrier 324, and the outer part 330B presses the press ring 328.

In the head body 322, a space 350 is formed in the head body 332, and the space 350 is made airtight by the rubber sheet 330 and the O-ring 346. The air supply passage 336 communicates with the space 350. When the compressed air is supplied into the space 350 through the air supply passage 336, the central part 330A of the rubber sheet 330 elastically deforms to press the top of the carrier 324 by the air pressure. Thus, it is possible to obtain a force which presses the wafer 354 against the polishing pad 316. By adjusting the air pressure by the regulator 342B, it is possible to control the force which presses the wafer 354. Reference numerals 356, 358 are O-rings for sealing.

The press ring 328 is arranged between the head body 322 and the carrier 324. A projection 370 is formed on the inner surface of the bottom of the head body 322, and the projection 370 supports the press ring 328 in a manner to prevent the press ring 328 from tilting.

An annular retainer ring 329 is detachably provided on the inner surface of the bottom of the press ring 328. When the edge of the wafer 354 meets the retainer ring 329, the position of the wafer 354 is regulated during the polishing. The retainer ring 329 is located away from the polishing pad 316. At least a part of the retainer ring 329 which may meets the wafer 354, is made of soft materials (ex. resin) so as to prevent the wafer 354 from chipping when the edge thereof meets the retainer ring 329. The abraded retainer ring 329 is replaced by a new one.

On the other hand, an annular space 366 is formed in the head body 322, and the space 366 is made airtight by the outer part 330B of the rubber sheet 330 and the O-rings 346, 356. The air supply passage 334 communicates with the space 366. When the compressed air is supplied into the space 366 through the air supply passage 334, the outer part 330B of the rubber sheet 330 elastically deforms to press the annular top surface of the press ring 328 by the air pressure. Thereby, the annular bottom surface of the press ring 328 is pressed against the polishing pad 316. By adjusting the air pressure by the regulator 342A, it is possible to control the force which presses the press ring 328.

The press ring 328 is coupled to the head body 322 via a stopper member (not shown), which prevents the press ring 328 from falling out of the head body 322. The carrier 324 is coupled to the press ring 328 via a stopper member (not shown), which prevents the carrier 324 from falling out of the press ring 328.

A description will be given of the method of polishing the wafer by the wafer polishing apparatus 300, which is constructed in the above-mentioned manner.

First, the pump 344 is driven to supply the compressed air to the air chamber 327 through the air passages 341, 337, 353 and form the pressurized air layer 355 between the porous board 352 and the wafer 354. The wafer 354 is pressed against the polishing pad 316 via the pressurized air layer 355.

Next, the compressed air is supplied to the space 350 from the pump 344 through the air passages 340, 336. The central part 330A of the rubber sheet 330 is elastically deformed by the inner air pressure to press the carrier 324. Thereby, the force is transmitted from the central part 330A of the rubber sheet 330 to the wafer 354 via the carrier 324 and the pressurized air layer 355, so that the wafer 354 can be pressed against the polishing pad 316. Then, the regulator 342B adjusts the pressure of the air supplied from the pump 344 to set the inner air pressure of the space 350 to desired pressure, so that the force which presses the wafer 354 against the polishing pad 316 can be maintained constant.

Then, the compressed air is supplied to the space 366 from the pump 344 through the air supply passages 338, 334, and the outer part 330B of the rubber sheet 330 is elastically deformed to press the press ring 328 against the polishing pad 316. The regulator 342A adjusts the pressure of the air supplied from the pump 344 to set the inner air pressure of the space 366 to desired pressure, so that the force which presses the press ring 328 against the polishing pad 316 can be maintained constant. Then, the turn table 312 is rotated in the direction of the arrow A by the motor 320, and the wafer holding head 314 is rotated in the direction of the arrow B to thereby start polishing the wafer 354.

The wafer 354 is supported by the carrier 324 via the pressurized air layer 355 while being polished, and thus, the rotational force of the turn table 312 which acts on the wafer 354 is not transmitted to the carrier 324. In this embodiment, the head body 322 supports the press ring 328 and the retainer ring 329 via the pressurized air in the space 366 formed with the rubber sheet 330. Thus, the rotational force of the turn table 312 which acts on the press ring 328 and the retainer ring 329 during the polishing is not transmitted to the carrier 324. Hence, it is possible to prevent the carrier 324 from tilting without increasing the polishing pressure, so that the wafer 354 can be polished accurately.

During the wafer 354 is polished, the rotational force of the turn table 312 is transmitted to the press ring 328, and the press ring 328 tries to swing horizontally due to the rotational force. In this embodiment, however, the press ring 328 does not swing horizontally since it is supported by the projection 370, which is formed on the inner surface of the bottom of the head body 322. Thus, a part of the polishing pad 316 which is enclosed by the press ring 328 can be maintained flat, so that the surface of the wafer 354 can uniformly be polished.

Moreover, if the polishing pad 316 is corrugated, the carrier 324 moves to follow the shape of the polishing pad 316 since the carrier 324 and the press ring 328 are supported via the pressurized air and the wafer 354 is pressed against the polishing pad 316 via the pressurized air layer 355. Thus, even if the polishing pad 316 is corrugated, the wafer 324 is uniformly polished because the whole surface of the wafer 324 is pressed against the polishing pad 316 under uniform pressure. Any other prior arts fail to disclose such a feature. The present invention significantly improves the wafer polishing accuracy compared with other prior arts.

In FIG. 9, the air is supplied to the space 350 to thereby press the carrier 324, but the present invention is not restricted to this. The water may be supplied to the space 350 to press the carrier 324. In other words, any fluid may be supplied to the space 350. This applies to the space 366, too.

The piezo-electric device in FIG. 5 or the leaf spring in FIG. 6 may be employed as the means which presses the carrier 324.

Further, the air jetting holes may be formed on the carrier as shown in FIG. 7 without using the porous material 352 as the air jetting member.

Two piezo-electric devices, the piezo-electric device and the air bag, the piezo-electric device and the spring, or the spring and the air bag may be employed as the pressing means of the carrier 324 and the press ring 328.

As set forth hereinabove, according to the polishing apparatus of the present invention, the wafer is uniformly pressed against the polishing surface by the pressurized fluid layer whether the wafer is deformed or not. Thus, the wafer is pressed against the polishing surface along the undulations and hollows. Thereby, it is possible to uniformly polish the wafer.

Moreover, according to the polishing apparatus of the present invention, the carrier supports the wafer via the pressurized fluid layer, and the head body supports the press ring and the retainer ring via the pressurized fluid. For this reason, the rotational force of the turn table is not transmitted to the carrier while the wafer is being polished. Thus, it is possible to prevent the carrier from tilting unnecessarily without increasing the polishing pressure under normal operating conditions when the polishing pad is not corrugated, so that the wafer can be polished accurately.

Furthermore, according to the present invention, if the polishing surface is corrugated, the carrier moves to follow the shape of the polishing surface since the carrier and the press ring are supported via the pressurized fluid and the wafer is pressed against the polishing surface via the pressurized fluid layer. Thus, even if the polishing pad is corrugated, the wafer is uniformly polished because the whole surface of the wafer is pressed against the polishing surface under uniform pressure.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A polishing apparatus which holds a wafer with a holding head and presses the wafer against a rotating turn table to thereby polish a face of the wafer, wherein said holding head comprises:

a head body which is rotatably arranged such that said head body faces said turn table;

a carrier which floats on said head body in such a manner as to move vertically;

an air jetting member which is provided at the bottom of said carrier and jets air to the other face of the wafer to thereby form a pressurized air layer between said carrier and the wafer;

pressing means whose pressing force for pressing said carrier toward said turn table is controlled to be a desired pressing force and presses said carrier toward said turn table with the controlled pressing force to thereby press the wafer against said turn table via said pressurized air layer; and wherein said polishing apparatus jets the air toward the other face of the wafer from said air jetting means, forms said pressurized air layer while flowing the air to the outside of said carrier, and transmits a pressing force of said pressing means to said wafer to thereby polish the wafer.

2. The polishing apparatus as defined in claim 1, wherein said pressing means presses said carrier via pressurized fluid.

3. The polishing apparatus as defined in claim 2, wherein the fluid is one of liquid and air.

4. The polishing apparatus as defined in claim 1, wherein said pressing means is one of a piezo-electric device and a magnetostriction device.

5. The polishing apparatus as defined in claim 1, wherein said pressing means is a spring member.

6. A polishing apparatus which holds a wafer with a holding head and presses the wafer against a rotating turn table to thereby polish a face of the wafer, wherein said holding head comprises:

a head body which is rotatably arranged such that said head body faces said turn table;

a carrier which floats on said head body in such a manner as to move vertically;

an air jetting member which is provided at the bottom of said carrier and jets air to the other face of the wafer to thereby form a pressurized fluid layer between said carrier and the wafer; and pressing means which presses said carrier toward said turn table to thereby press the wafer against said turn table via said pressurized fluid layer;

wherein said air jetting member is a porous member.

7. The polishing apparatus as defined in claim 1, wherein said air jetting member is a member on which air jetting holes are formed.

8. The polishing apparatus as defined in claim 1, wherein said air jetting member is said carrier on which air jetting holes are formed.

9. A polishing apparatus which holds a wafer with a holding head and presses the wafer against a rotating turn table to thereby polish a face of the wafer, wherein said holding head comprises:

a head body which is rotatable arranged such that said head body faces said turn table;

a carrier which floats on said head body in such a manner as to move vertically;

an air jetting member which is provided at the bottom of said carrier and jets air to the other face of the wafer to thereby form a pressurized fluid layer between said carrier and the wafer; and pressing means which presses said carrier toward said turn table to thereby press the wafer against said turn table via said pressurized fluid layer;

wherein said air jetting member comprises:

a first air jetting member which jets the air to a central part of the wafer;

a second air jetting member which jets the air to an edge part of the wafer; and wherein pressure applied to the edge part of the wafer by the air jetted from said second air jetting member is set lower than pressure applied to the central part of the wafer by the air jetted from said first air jetting member.

10. The polishing apparatus as defined in claim 9, wherein said first and second air jetting members are porous members.

11. The polishing apparatus as defined in claim 9, wherein said first and second air jetting members are members on which air jetting holes are formed.

12. A polishing apparatus which holds a wafer with a holding head and presses the wafer against a rotating turn table to thereby polish a face of the wafer, wherein said holding head comprises:

a head body which is rotatably arranged such that said head body faces said turn table;

a carrier which floats on said head body in such a manner as to move vertically;

an air jetting member which is provided at the bottom of said carrier and jets air to the other face of the wafer to thereby form a pressurized air layer between said carrier and the wafer;

first pressing means whose pressing force for pressing said carrier toward said turn table is controlled to be a desired pressing force and presses said carrier toward said turn table with the controlled pressing force to thereby press the wafer against said turn table via said pressurized air layer;

a press ring which is supported by said head body in such a manner as to move vertically and which is concentrically arranged outside said carrier, said press ring enclosing the wafer during polishing;

second pressing means which presses said press ring against said turn table; and wherein said polish apparatus jets the air toward the other face of the wafer from said air jetting means, forms said pressurized air layer while flowing the air to the outside of said carrier, and transmits a pressing force of said first pressing means to said wafer to thereby polish the wafer.

13. The polishing apparatus as defined in claim 12, wherein a retainer ring is provided at an inner surface of said press ring, said retainer ring regulating a position of the wafer during polishing.

14. The polishing apparatus as defined in claim 13, wherein at least a part of said retainer ring which meets the wafer is made of resin.

15. The polishing apparatus as defined in claim 12, wherein said first pressing means presses said carrier via pressurized fluid, and said second pressing means presses said press ring via pressurized fluid.

16. The polishing apparatus as defined in claim 15, wherein said fluid is one of liquid and air.

17. The polishing apparatus as defined in claim 12, wherein at least one of said first and second pressing means is one of a piezo-electric device and a magnetostriction device.

18. The polishing apparatus as defined in claim 12, wherein at least one of said first and second pressing means is a spring member.

19. A polishing apparatus which holds a wafer with a holding head and presses the wafer against a rotating turn table to thereby polish a face of the wafer, wherein said holding head comprises:

a head body which is rotatable arranged such that said head body faces said turn table;

a carrier which floats on said head body in such a manner as to move vertically;

an air jetting member which is provided at the bottom of said carrier and jets air to the other face of the wafer to thereby form a pressurized fluid layer between said carrier and the wafer; and first pressing means which presses said carrier toward said turn table to thereby press the wafer against said turn table via said pressurized fluid layer;

a press ring which is supported by said head body in such a manner as to move vertically and which is concentrically arranged outside said carrier, said press ring enclosing the wafer during polishing; and second pressing means which presses said press ring against said turn table;

wherein said air jetting member is a porous member.

20. The polishing apparatus as defined in claim 12, wherein said air jetting member is a member on which air jetting holes are formed.

21. The polishing apparatus as defined in claim 12, wherein said air jetting member is said carrier on which air jetting holes are formed.

22. A polishing apparatus which holds a wafer with a holding head and presses the wafer against a rotating turn table to thereby polish a face of the wafer, wherein said holding head comprises:

a head body which is rotatable arranged such that said head body faces said turn table;

a carrier which floats on said head body in such a manner as to move vertically;

an air jetting member which is provided at the bottom of said carrier and jets air to the other face of the wafer to thereby form a pressurized fluid layer between said carrier and the wafer; and first pressing means which presses said carrier toward said turn table to thereby press the wafer against said turn table via said pressurized fluid layer;

a press ring which is supported by said head body in such a manner as to move vertically and which is concentrically arranged outside said carrier, said press ring enclosing the wafer during polishing; and second pressing means which presses said press ring against said turn table;

wherein said air jetting member comprises:

a first air jetting member which jets the air to a central part of the wafer;

a second air jetting member which jets the air to an edge part of the wafer; and wherein pressure applied to the edge part of the wafer by the air jetted from said second air jetting member is set lower than pressure applied to the central part of the wafer by the air jetted from said first air jetting member.

23. The polishing apparatus as defined in claim 22, wherein said first and second air jetting members are porous members.

24. The polishing apparatus as defined in claim 22, wherein said first and second air jetting members are members on which air jetting holes are formed.

25. The polishing apparatus as defined in claim 12, wherein a projection is formed on the bottom of said head body, said projection is in contact with a circumferential surface of the bottom of said press ring to prevent said press ring from tilting.

* * * * *